US006750730B2

(12) United States Patent
Heisen et al.

(10) Patent No.: US 6,750,730 B2
(45) Date of Patent: Jun. 15, 2004

(54) TUNING ARRANGEMENT FOR A MICROWAVE DEVICE

(75) Inventors: Stephan Heisen, Sulzbach (DE); Siegbert Martin, Oppenweiler (DE); Hauke Schuett, Bünsdorf (DE); Jürgen Ebinger, Aspach (DE)

(73) Assignee: Marconi Communications GmbH, Backnang (DE)

( * ) Notice: Subject to any disclaimer, the term of this patent is extended or adjusted under 35 U.S.C. 154(b) by 0 days.

(21) Appl. No.: 10/137,120

(22) Filed: May 1, 2002

(65) Prior Publication Data

US 2003/0206074 A1 Nov. 6, 2003

(51) Int. Cl.[7] ..... H01P 5/00
(52) U.S. Cl. ..... 333/1; 333/207
(58) Field of Search ..... 333/1, 207, 81, 333/204, 205, 206, 1.1, 202

(56) References Cited

U.S. PATENT DOCUMENTS

| | | | | |
|---|---|---|---|---|
| 3,624,555 A | | 11/1971 | Klein | |
| 3,869,681 A | | 3/1975 | Klein et al. | |
| 4,535,308 A | | 8/1985 | Znojkiewicz | |
| 4,794,354 A | * | 12/1988 | Dinsmore et al. | 333/207 |
| 6,066,992 A | | 5/2000 | Sadaka et al. | |
| 6,255,922 B1 | * | 7/2001 | Malmstrom et al. | 333/219.1 |

FOREIGN PATENT DOCUMENTS

| | | |
|---|---|---|
| DE | 33 44 285 A1 | 6/1985 |
| DE | 40 26 062 A1 | 2/1992 |
| GB | 2 320 369 A | 6/1998 |
| GB | 2 354 885 A | 4/2001 |

OTHER PUBLICATIONS

*Rigorous Analysis of Non–Homogeneous Gyrotropic Waveguides by the Method of Lines*, Piers 1998 Proceedings, Session C09, Siegbert Martin, et al., p. 1167.

*Rigorous Analysis of Non–Homogeneous Gyrotropic Devices with the Method of Lines*, S. Martin, Marconi Communications GmbH, Germany, Progress in Electromagnetics Research Symposium, Jul. 5–14, 2000, Cambridge MA, p. 361.

*Automatic Computer–Controlled Tuning System for Microwave Filters*, P. Harscher, et al., 30$^{th}$ European Microwave Conference—Paris 2000, pp. 39–42.

* cited by examiner

*Primary Examiner*—Brian Young
*Assistant Examiner*—Joseph Lauture
(74) *Attorney, Agent, or Firm*—Kirschstein, et al.

(57) ABSTRACT

The invention generally relates to tuning arrangements and tuning components for influencing an electric field in a microwave device, in particular in a microwave communication device such a microwave circulator and isolator, comprising a tuning element having a tuning portion which co-operates with the housing of the device in an electrically non-conductive manner.

35 Claims, 9 Drawing Sheets

TUNING ARRANGEMENT FOR A MICROWAVE DEVICE

FIELD OF THE INVENTION

This invention generally relates to tuning arrangements and tuning components for use in microwave devices, in particular for use in microwave communication devices such as microwave circulators and isolators.

BACKGROUND OF THE INVENTION

Microwave devices such as microwave circulators or microwave isolators, e.g. for use in radio link systems, generally comprise closed conductive housings defining a cavity. Typically, these housings consist of two half shells made from metal and their production technique is based on milling and drilling. Microwave circulators/isolators of the kind are, for example, described in U.S. Pat. No. 6,066,992 and GB 2 320 369 A, and GB 2 354 885 A.

In the case of microwave circulators or isolators, the two metal half shells are screwed together after assembly of, for instance, a strip-line conductor, ferrites, and flange adapters, e.g. SMA flange adapters. The tolerances of the ferrites are compensated by mechanical adjustment or integration of soft sheets on the ferrite disks. In order to satisfy electromagnetic compatibility (EMC) requirements, silver loaded epoxy is used to close leakage gaps. However, in spite of this elaborate and costly construction, the EMC behavior may change over time, and the isolator tends to leak again after 1 or 2 years.

Recently, housings made from metallized plastic have been proposed (cf. E. Habinger, A. Sidhu, G. Blasek, "Metallisieren von Kunststoffgehäusen unter EMV-, Umwelt-, and Recyclingaspekten", Eugen G.Leuze Verlag, Saulgau, 1998). By the implementation of plastic technology assembly time production cost can be reduced.

Generally, a tuning arrangement is also arranged at the housing. The tuning arrangement typically comprises a rod like tuning element made from a conductive material having one portion, referred to as the tuning portion, protruding into the cavity and thereby concentrating the electromagnetic field in the region of the tuning element. Another portion of the tuning element, referred to as the locking portion, mechanically engages the housing thereby forming an electrically conductive connection with the housing. Typically, the tuning element engages the housing via a screw thread. By rotating the tuning element with respect to the housing the protrusion length of the tuning element, i.e. of the tuning portion, can be adjusted and the resonant frequency of the cavity can be controlled.

In microwave circulators or insulators, the application of tuning elements is generally necessary to compensate material parameter tolerances of magnets and ferrites. In addition, the mechanical variation of the stripline center conductor can be compensated. In this case rotating tuning elements, having a locking portion configured as a thread, provide an ideal interface for automated tuning devices described in P. Harscher, J. Hoffmann, R. Vahldieck, B. Ludwig, "Automatic computer-controlled tuning system for microwave filters", 2000 EuMC Conference Proceedings, Paris, 2000, October, Vol.1, pp 39–42.

FIG. 1 shows a prior art tuning element 1 basically formed as a screw and acting as an adjustable shunt capacitor $C_t$ towards the center conductor 3. The displacement current between the tuning portion 5 and the center conductor 3 generates a surface current on the locking portion 7, i.e. on the thread. In this configuration the thread has to provide a perfect electrical contact with the housing 9.

In a solid metal housing this can be obtained without problems. In housings made from metallized plastic, however, the reliability of the electrical connection presents a problem, considering difficulties related to the metallization process of threads as well as avoiding destruction of contact surfaces while pushing sockets into such metallized housings.

It is therefore an object of the invention to provide a reliable tuning arrangement which can be utilized in metal housings as well as in plastic housings of microwave devices.

SUMMARY OF THE INVENTION

In order to satisfy this and other objects, the present invention provides a tuning arrangement for influencing an electric field within a microwave device having electrically conductive walls for guiding microwaves, the arrangement comprising at least one tuning element capacitively coupled to a portion of said electrically conductive walls through a physical connection therewith, the physical connection being an electrically insulating connection.

Due to the insulating nature of the connection between the tuning element and the electrically conductive walls of the microwave device, e.g. the housing of the device, this tuning arrangement is particularly well suited for housings made from metallized plastic in which the metallization may be abraded during mounting of the tuning arrangement in the housing.

Alternatively, this tuning element is well suited for applications where passive intermodulation arises from contact problems of a screw used to connect the tuning element to the or a housing.

Preferably, the tuning element comprises, in sequence, a tuning portion for influencing the electric field, a capacitive coupling portion which couples capacitively with said portion of said electrically conductive walls, an insulating portion, and a conductive or insulating locking portion. Due to this design, particularly due to the insulating portion of the tuning element, an electrical separation of the tuning portion and the locking portion is achieved forcing the tuning portion to interact capacitively with the housing of the device.

In accordance with another aspect of the present invention, a microwave device is provided comprising electrically conductive walls for guiding microwaves and at least one tuning element protruding into a space defined by said electrically conductive walls for influencing said microwaves, said tuning element being capacitively coupled to a portion of said electrically conductive walls through a physical connection therewith, the physical connection being an electrically insulating connection.

Preferably, the electrically conductive walls are made from metallized plastic. Due to the implementation of plastic technology for microwave components, e.g. by realizing a complete housing by two metallized plastic parts, which are screwed together, and by using e.g. push-in connectors, the assembly effort and assembly time of the device of the invention can be reduced. Further, the housing may be made elastic and, thus, can properly compensate the mechanical tolerances in the ferrite region. The assembly technique and the material characteristics yield excellent EMC behavior. Moreover, for a modular radio or microwave system the same housing can be applied for a wide frequency spectrum (e.g. 5.9 GHz–13.5 GHz).

Preferably, a portion of the electrically conductive walls adjacent to ferrite disks arranged on opposite sides of a center conductor is elastic. Due to the elastic behavior of the electrically conductive walls the ferrite disks and the electrically conductive walls are pressed together. Hence, air gaps between the ferrite disks and the housing can be avoided in a simple manner. Mechanical tolerances can be compensated by this membrane-concept.

When the microwave device is realized as an isolator, an absorber element incorporated in the device is advantageously formed from an attenuating silicone material. This material is elastic and adapts to the housing geometry allowing an easy and quick integration. Minor deformations do not influence the return loss. Since the design tolerates slight deviations this silicone absorber can be produced using casting techniques. The position in the housing may be fixed using a "snap-in technique".

In accordance with still another aspect of the present invention, a tuning component is provided comprising a metal socket or an insulating socket for insertion into a space defined by electrically conductive walls and a tuning element, the tuning element comprising a conductive or insulating locking portion having a screw thread engagable with said socket, an insulating portion connected to said locking portion and a tuning portion connected to said insulating portion and remote from said locking portion.

In accordance with yet another aspect of the present invention, a method of influencing an electrical field in a microwave device having electrically conductive walls for guiding microwaves is provided, the method comprising the step of adjusting the protrusion of at least one tuning element into a space defined by said electrically conductive walls with the tuning element coupling capacitively with a portion of said electrically conductive walls.

The above objects and other objects, features, and advantages of the present invention are readily apparent from the following detailed description of a preferred mode for carrying out the invention when taken with the accompanying drawings.

DESCRIPTION OF ILLUSTRATED EMBODIMENTS

Figure 2:
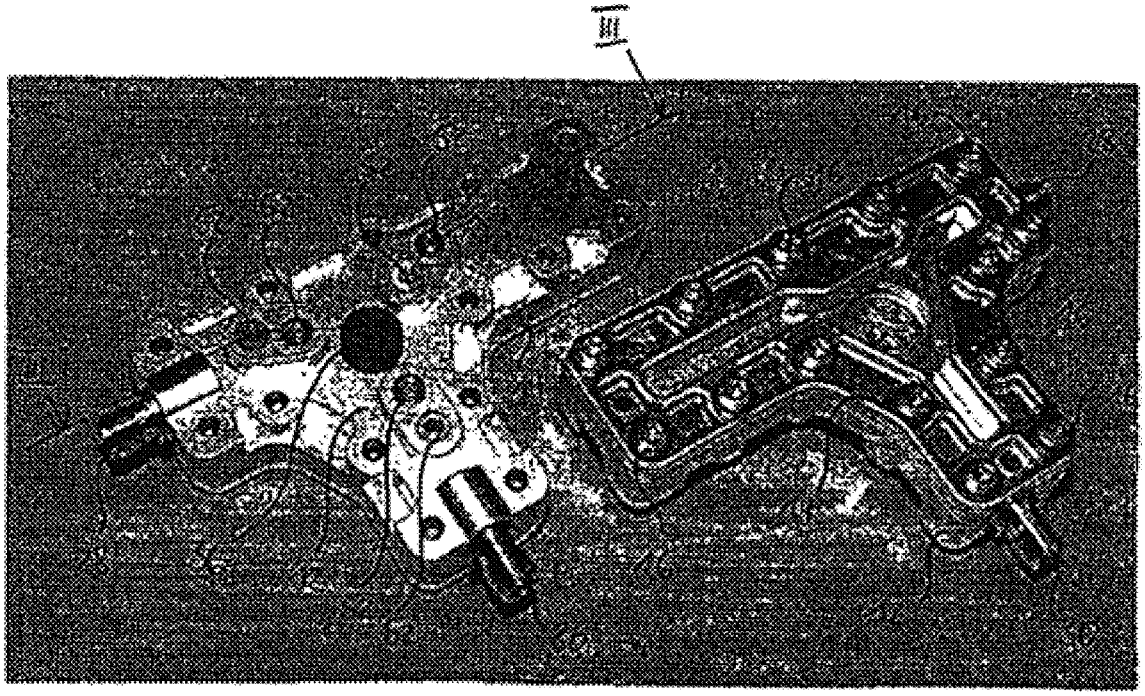
FIG. 2 is a bottom view (left) and a top view (right) of a microwave device of the invention.

FIG. 2 shows a bottom view (left) and a top view (right) of a microwave device of the invention, in this case a microwave isolator 10 which is based on a classic microwave circulator design approach where one port is terminated by a load. The basic theory and typical design parameters of microwave circulators and isolators are published in D. K. Linkhart, "Microwave Circulator Design", Artech House, INC., Norwood, 1989, and J. Helszajn, "Nonreciprocal Microwave Junctions and Circulators", John Wiley & Sons, New York, 1975. A complete theory for analyses of gyrotropic devices is presented in S. Martin, R. Pregla, "Rigorous analysis of non-homogeneous gyrotropic waveguides by the method of lines", 1998 PIERS Conference Proceedings, Nantes, 1998, July, Vol.3, pp 1167 and S. Martin, "Rigorous analysis of non-homogeneous gyrotropic devices with the method of lines", 2000 PIERS Conference Proceedings, Cambridge (USA), 2000, July, pp 361.

The microwave isolator 10 comprises a housing made from two molded plastic parts 12, 14 which are screwed together by self-forcing screws 16. This can, for instance, be done by automated screwing machines.

The plastic of the housing parts 12, 14 has a low thermal expansion coefficient in order to be particularly temperature stable. A suitable plastic is, for example, ULTEM of GE Plastics, USA. The molded plastic parts 12, 14 are provided with reinforcements adding to the stability of the plastic against mechanical stress and to the long term stability of the plastic in general.

Since, the basic housing material is an electric insulator it has to be plated by a metallic layer. In this case the plastic parts 12, 14 are plated over all surfaces with a silver layer having a layer thickness of about 10 $\mu$m.

The layer thickness is defined mainly by the operating frequency of the device 10 and the EMC demands. The penetration depth can be calculated by $$\delta = \sqrt{\frac{2}{\omega\kappa\mu}}$$

with $\omega$ being the radian frequency of the microwaves, $\kappa$ being the conductivity, and $\mu$ being the permeability of the layer material. The penetration depth in silver is 2 $\mu$m at 1 GHz. The used layer thickness of 10 $\mu$m is therefore a conservative approach.

Figure 3:
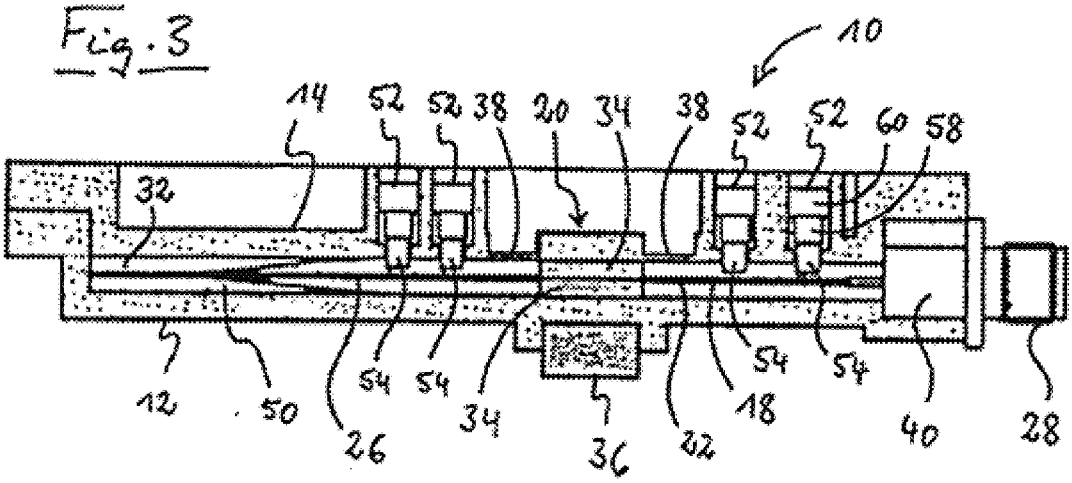
FIG. 3 is a schematic cross section of a microwave device of the invention, resembling the complex section III—III of FIG. 1 but rotated through 180° and with the tuning elements inserted from the other side.

The housing of the device 10 defines a 3-way junction with a strip-line center conductor 18 centrally arranged between the two housing parts 12, 14, as shown in FIG. 3. The strip-line center conductor 18 may be formed from sheet metal, e.g. of copper, and has a Y-shaped configuration comprising a central region 20 and three legs 22–26 arranged symmetrically around the central region 20 (cf. FIG. 7). Two of the legs 22, 24 are connected to respective input and output ports 28, 30, and the third leg 26 is connected to an isolated port 32 (cf. FIG. 2).

Figure 4:
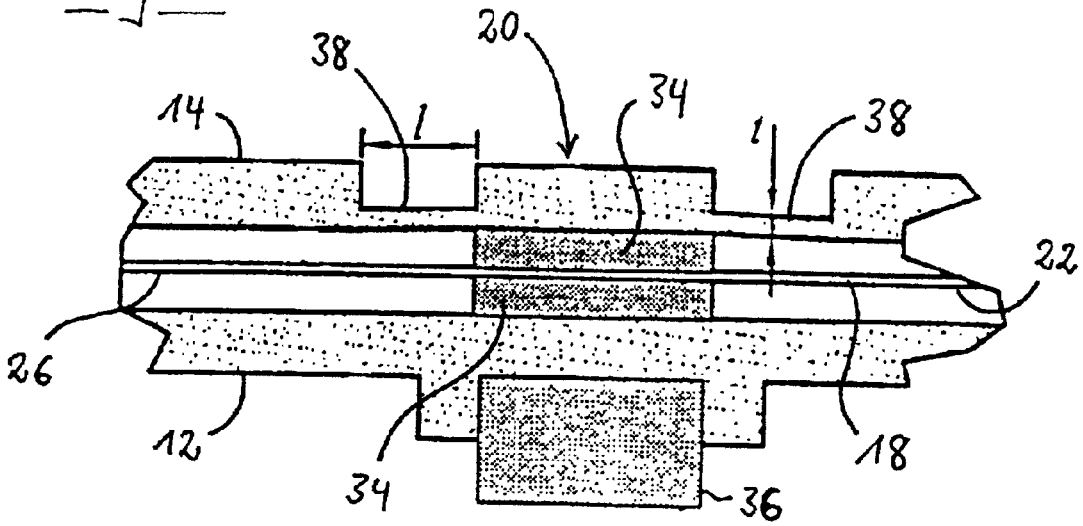
FIG. 4 is a schematic cross section of the ferrite region of the microwave device in FIG. 3.

As can be seen in FIG. 4, the central region 20 of the strip-line center conductor 18 is sandwiched between a pair of ferrite disk resonators 34 forming a ferrite region also denoted by reference numeral 20. Suitable ferrite materials include ferrimagnetic spinels such as nickel iron oxide ($NiFe_2O_4$) and garnets such as yttrium ion garnet ($Y_3Fe_5O_{12}$).

A permanent magnet 36 is arranged at one of the plastic housing parts 12 for magnetically biasing the ferrite region 20 of the strip-line center conductor 18. To reduce the number of parts, a yoke for the magnetic system was eliminated. Hence, the ferrite disks 34 are magnetized from one side only. Since the homogeneity of magnetization of the ferrite disks 34 has an important influence on the performance of the isolator 10, it has to be considered carefully.

Figure 5:
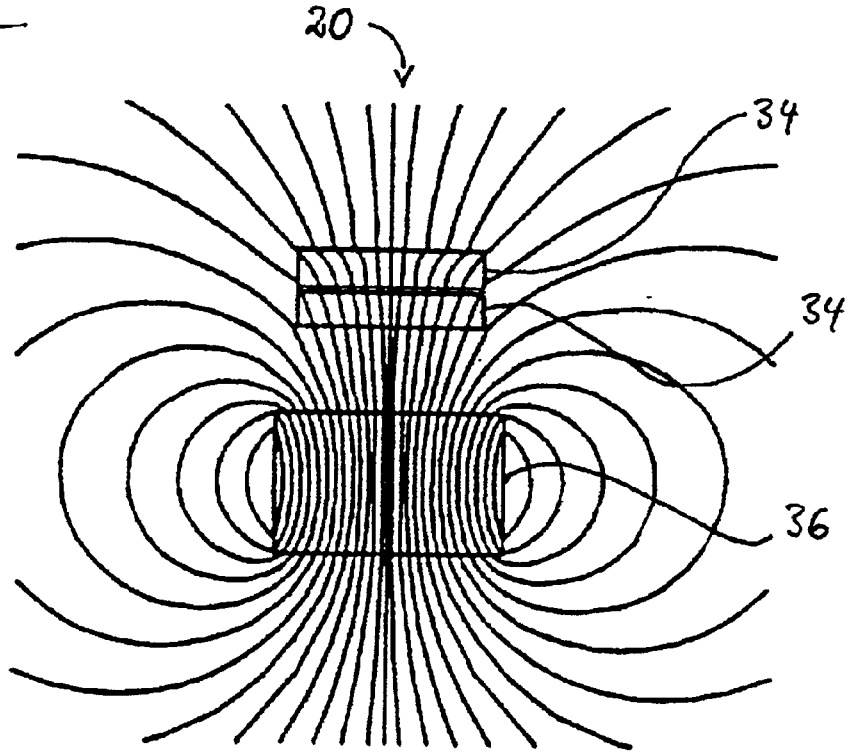
FIG. 5 is a calculated static magnetic field distribution in the ferrite region of FIG. 4.

A device in which the orientation of the static magnetic field varies inside a ferrite region can be simulated according to the theory given in S. Martin, "Rigorous analysis of non-homogeneous gyrotropic devices with the method of lines", 2000 PIERS Conference Proceedings, Cambridge (USA), 2000, July, pp 361. FIG. 5 depicts the resulting magnetic field distribution in the ferrite region 20 of FIG. 4.

At the junction resonant frequency, the magnetic field component of the microwave radiation interacts with the magnetic moment of the ferrite material 34 causing a change in the microwave permeability of the ferrite material 34. The effect of this is to rotate the electric and magnetic field vectors of the microwave radiation causing a change in propagation direction along the strip-line center conductor 18 if the microwave radiation is circularity polarized.

Figure 6:
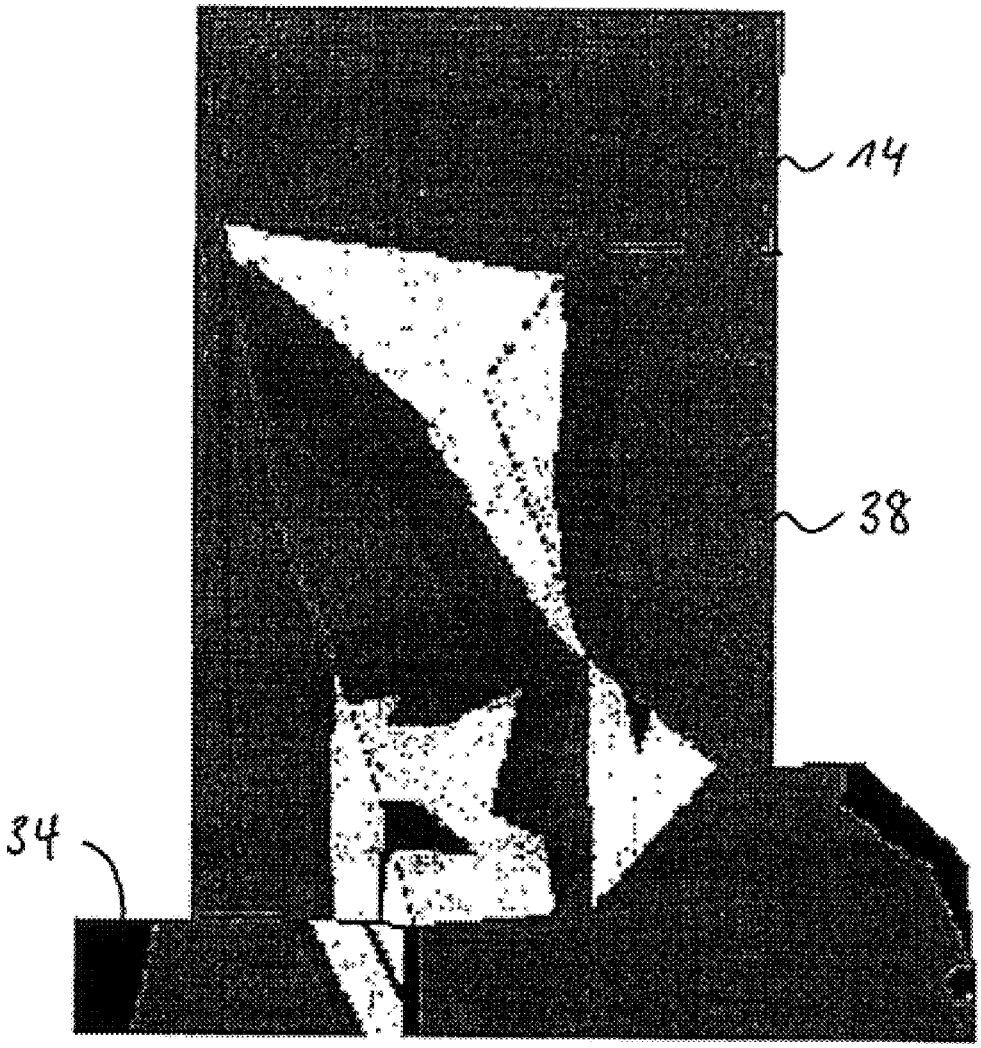
FIG. 6 shows a FEM (finite element method) analysis of the housing adjacent the ferrite region of FIG. 4.

The geometry of the ferrite region 20 is designed in such a way, that no air gaps exist between the ferrite disks 34 and the adjacent surfaces of the housing parts 12, 14, respectively. To this end, each housing part 12, 14 is formed in a thin, membrane-like manner in a membrane region 38 surrounding the ferrite region 20. Their elastic behavior in this membrane region 38 ensures that the ferrite disks 34 and the housing parts 12, 14 are in close contact with each other when the housing parts 12, 14 are pressed together. Due to the membrane-concept mechanical tolerances of the ferrite disks 34 and of the housing parts 12, 14 are compensated. The membrane 38 has to be designed carefully and its thickness t and length l are critical design parameters. Based on finite element method (FEM) tools, the stress inside the plastic material 12, 14 was determined and is illustrated in FIG. 6. The following parameters have to be observed:

- maximum stress has to be lower than the fluid rate of the applied plastic material,
- metallized surface has to withstand the deformation,
- the force pressing the ferrites, housing and stripline together has to be high enough to avoid air gaps,
- the material has to withstand the applied stress at maximum displacement,
- compensation of thermal expansion.

The operating center frequency can be tuned by the strip-line resonator geometry, which makes it possible to use the same ferrite disks 34 and housing geometry 12, 14 for different frequency bands of microwaves.

Figure 7:
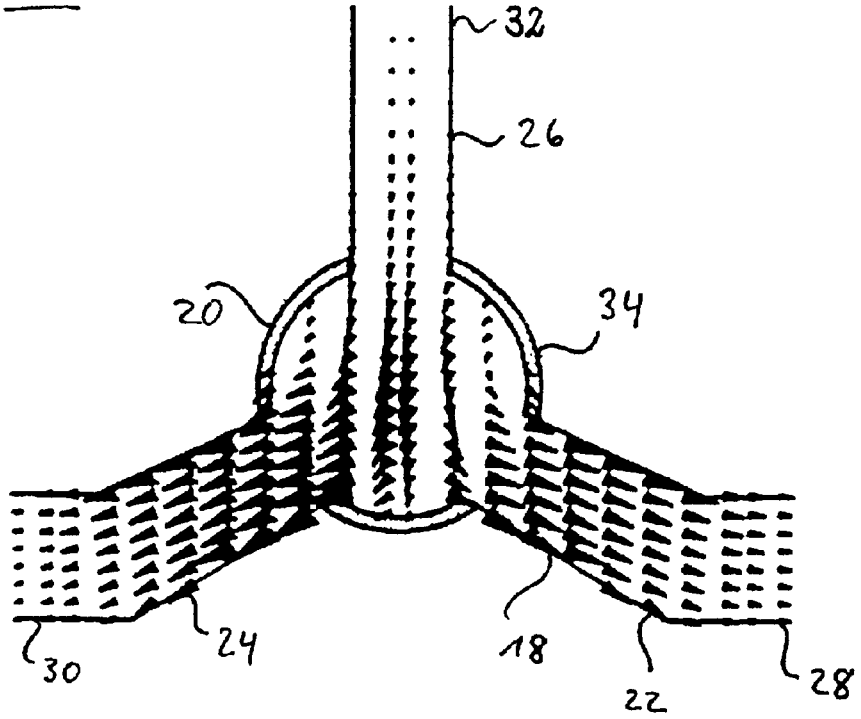
FIG. 7 is the calculated surface current at the stripline in the ferrite region of FIG. 4.

The current along the surface of the strip-line center conductor 18 within the ferrite region 20 is plotted in FIG. 7. The current flow between the input port 28 and output port 30 is evident. Vanishing currents can be observed at the isolated port 32.

An important challenge is the implementation of RF connectors within metallized plastic housings for microwave applications. Particular design constraints are:

- EMC requirements,
- easy and fast assembly technique,
- low insertion loss,
- impedance matched RF transmission,
- high torque against twisting,
- high pull-off force,
- metallized surface has to be conserved at the microwave relevant region,
- long term stability of microwave characteristics.

Figure 8:
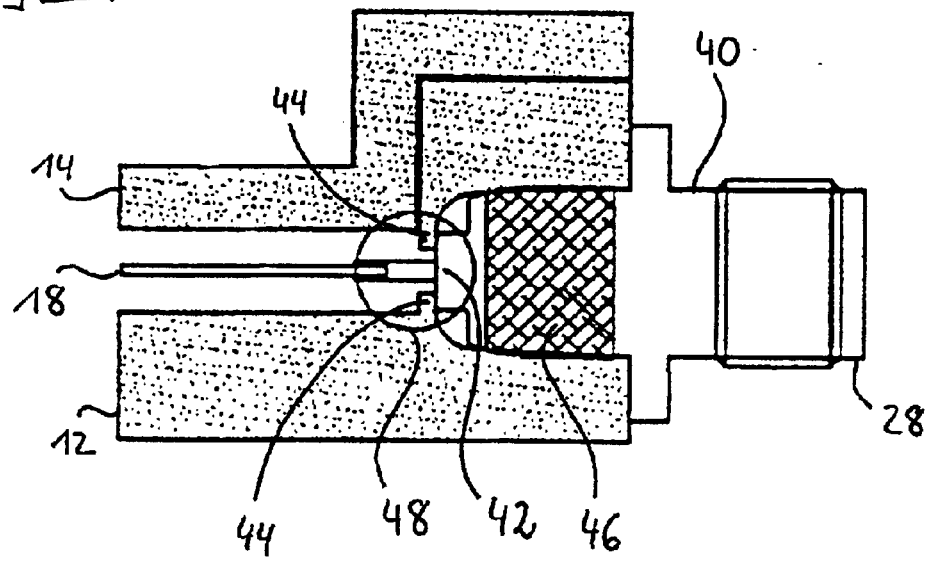
FIG. 8 is a cross section of a coaxial connector of the microwave device in FIG. 2.

These requirements are realized by the press-in connector 40 shown in FIG. 8. The electrical contact between the connector 40 and the strip-line center conductor 18 is obtained at the rear end 42 of the connector 40, for instance by soldering. The housing parts 12, 14 are provided with lips 44 each engaging the rear end 42 of the pressed in connector 40. The lips 44 have a spring characteristic for compensating mechanical tolerances of the housing parts and of the connector 40. The mechanical characteristic of torque and pull-off force, as defined by the respective standards, is achieved by knurling 46 formed on an outer surface of the connector 40 and engaging with the housing parts 12, 14.

Due to this press-in arrangement the assembly time of the microwave isolator 10 is reduced to a minimum. In order to provide a matched transition, the complete contact region 48 has a 50Ω line impedance yielding a high return loss.

Figure 9:
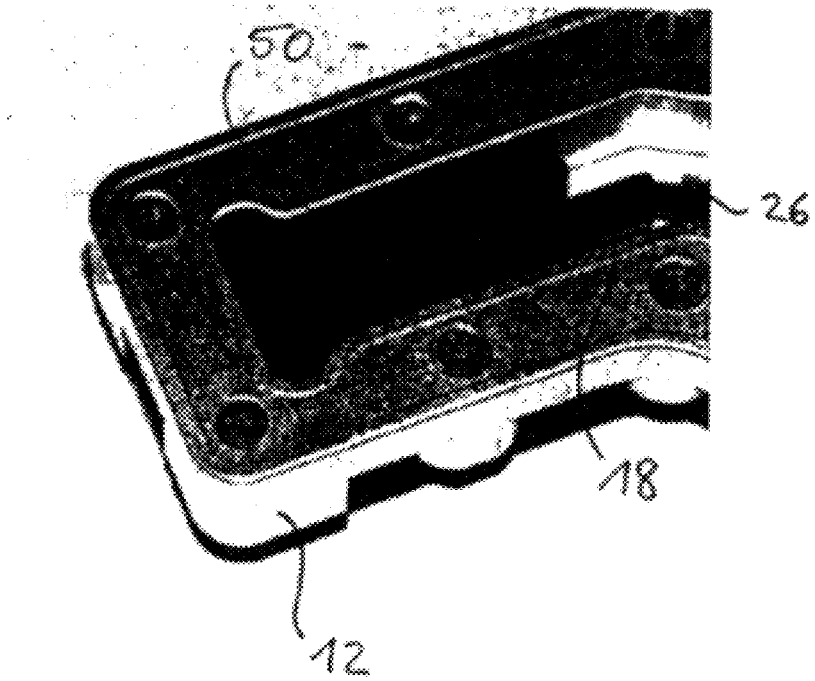
FIG. 9 shows the isolated port including the silicone load of the microwave device in FIG. 2.

As illustrated in FIG. 9, the isolated port 32 of the microwave isolator 10 is terminated by a load 50. Particular requirements imposed on the load 50 are high return loss, temperature stable characteristics, good long term behavior, simple configuration, easy manufacturing, and quick assembly.

The load 50 is formed from a microwave attenuating silicone material. The material is elastic and fits itself to the housing geometry. Due to this an easy and quick integration is possible. Minor deformations do not influence the return loss. Owing to a design tolerating slight deviations this silicone part 50 can be produced using casting techniques. The position in the housing 12, 14 is fixed using a "snap-in technique".

The implementation of tuning elements in microwave circulators or isolators is generally necessary to compensate material parameter tolerances of magnets and ferrites. In addition, the mechanical variation of the stripline center conductor can be compensated. Rotating elements with a thread provide an ideal interface for automated tuning devices, as e.g. described in P. Harscher, J. Hoffmann, R. Vahldieck, B. Ludwig, "Automatic computer-controlled tuning system for microwave filters", 2000 EuMC Conference Proceedings, Paris, 2000, October, Vol.1, pp 39–42. Significant requirements of tuning elements are the feasibility of automatic tuning, no electrical contact problems, and an easy integration. The microwave isolator illustrated in FIGS. 2 and 3 is provided with two tuning elements 52 at each leg 22–26 of the strip-line center conductor 18.

Figure 10:
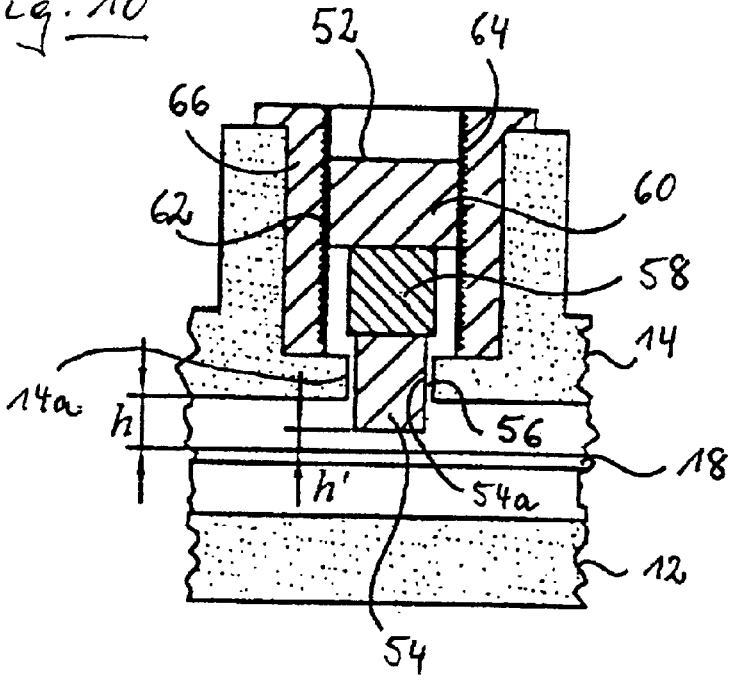
FIG. 10 is a cross section of a tuning arrangement in the microwave device in FIG. 2.

Referring to FIG. 10, a tuning element 52 of the invention comprises a tuning portion 54 protruding into the cavity formed by the housing 12, 14.

A capacitive coupling portion 54*a* of the tuning portion 54 and the surrounding part 14*a* of the housing 14 form an air gap 56. Preferably, the tuning portion 54 has a cylindrical shape and its outer surface is parallel to the opposing wall 14*a* of the housing 14. However, the tuning portion 54 can also be of polygonal, rectangular or square cross-section or of conical, spherical, tapering, grooved, or ribbed shape with the opposing housing wall 14*a* being adapted thereto if necessary. The dimensions of the tuning portion 54 as well as of the air gap 56 may vary between mm range and cm range depending on the microwave frequency used which may range from 100 mHz to 200 GHz.

An insulating portion 58 is connected to the tuning portion 54 and a conductive portion 60 is connected to the insulating portion 58 remote from the tuning portion 54. The conductive portion 60 has a self-locking thread 62 engaging the internal thread 64 of a metal socket 66 arranged in the housing 14. The socket 66 is pressed into the housing 14 which may injure the surface of the housing 14 with the consequence of an undefined electrical contact of socket 66 and housing metallization. However, this is not critical because of tunable capacitive coupling between the tuning portion 54 and the housing 14.

By rotating the tuning element 52 in the socket 66, for instance by hand or automatically, the protrusion depth of the tuning portion 54 in the cavity of the housing 12, 14 can be varied thereby influencing the electromagnetic field in the microwave insulator 10.

Figure 11:
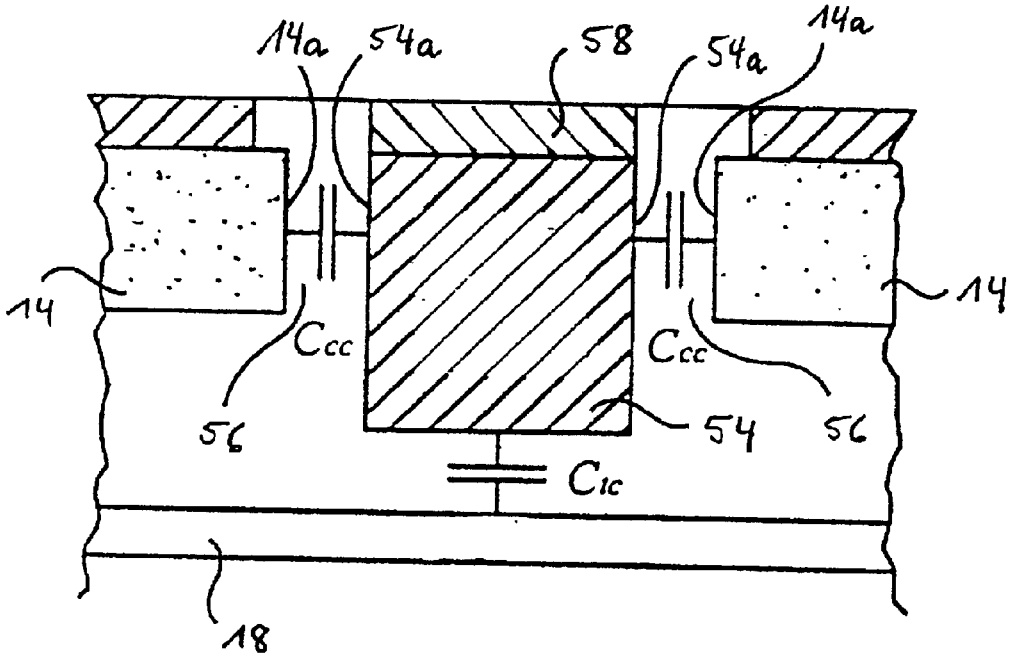
FIG. 11 is an equivalent circuit of the tuning arrangement in FIG. 10.

The principle function of the tuning element 52 of the invention is sketched in FIG. 11. The tuning element 52 exhibits two capacities. $C_{tc}$ is the actually needed tuning capacity between the tuning portion 54 and the center conductor 18. $C_{cc}$ presents a fixed and constant coupling capacity between the tuning portion 54 and the metallized plastic housing 14. The tuning portion 54 is isolated from the rest of the tuning element 52 by the insulating portion 58 as well as from the housing 14 by the air gap 56. Hence, a surface current along the thread as in prior art tuning elements is substituted by a displacement current flowing from the tuning region at the free end of the tuning portion 54 via $C_{tc}$ and $C_{cc}$ directly to the housing 14.

Due to this arrangement, no galvanic contact is necessary between the tuning portion 54 and the plastic housing 14. An undamaged metallic surface is necessary only in the region of the capacitive coupling, i.e. in the region of the housing wall 14*a* defining the air gap 56. The self-locking thread 62 is insulated against the tuning portion 54 and only needed as a mechanical support. Galvanic contacts between threads 62 and 64 are therefore not necessary.

The capacitively coupled tuning element 52 consists of a series connection of two capacitors $C_{cc}$ and $C_{tc}$. Therefore the effective capacitance is lower than $C_{cc}$ or $C_{tc}$.

Figure 1:
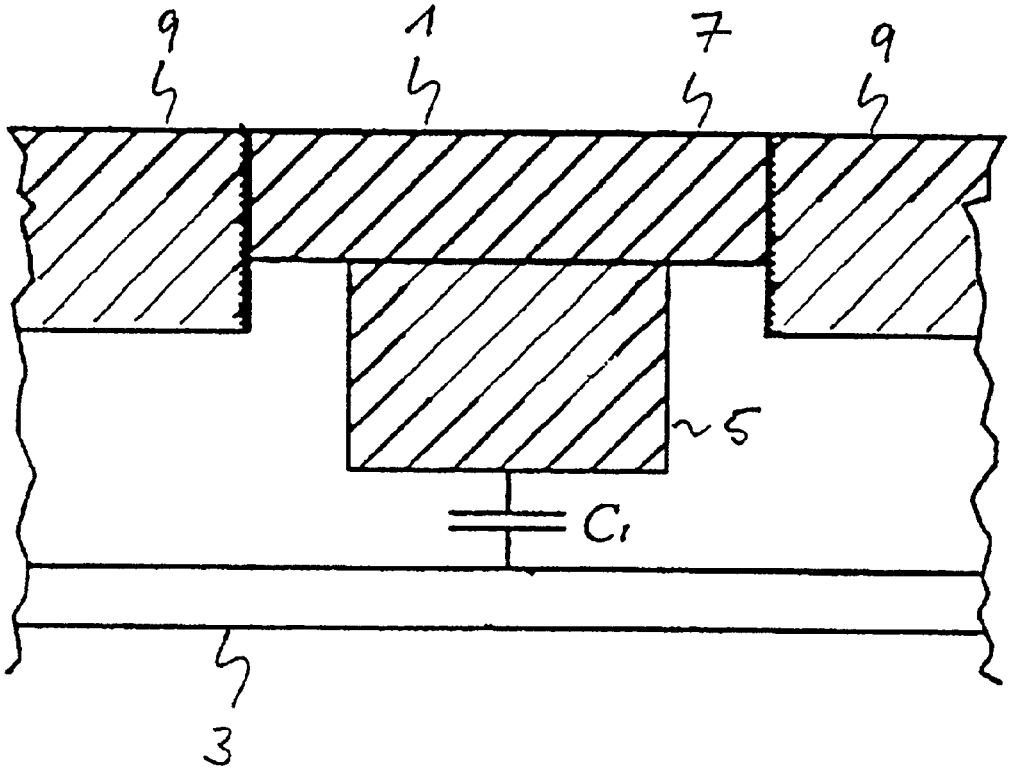
FIG. 1 is an equivalent circuit of a prior art tuning element.
Figure 12:
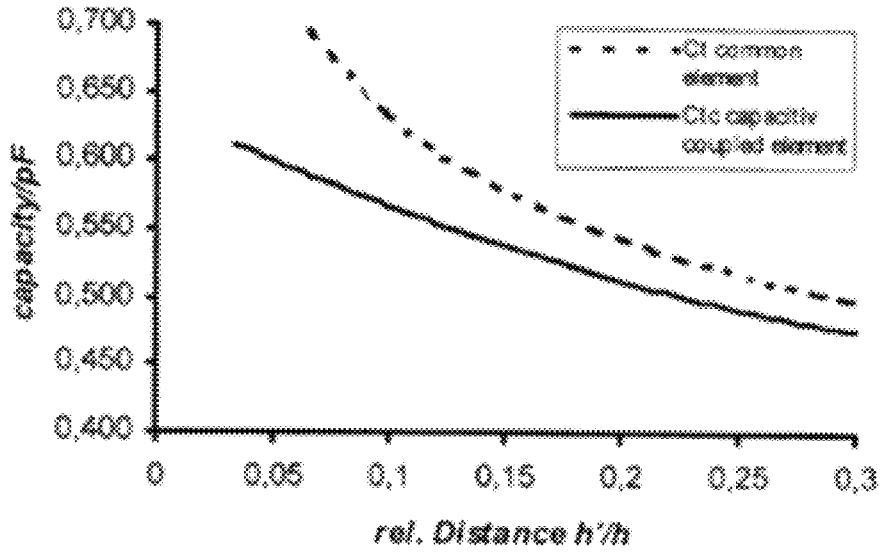
FIG. 12 is a graph showing the calculated capacities of a prior art tuning element in accordance with FIG. 1 and of a tuning element of the invention as shown in FIG. 10.

The prior art tuning variant, as shown in FIG. 1, and the tuning variant of the invention, as shown in FIGS. 10 and 11, have been compared by 3D simulation of their respective structures. In the tuning variant of the invention a closer distance between the tuning portion 54 of the tuning element 52 and the center conductor 18 is needed, but the range of values for $C_t$ and $C_{tc}$ are comparable as can be seen from FIG. 12. This figure shows realizable capacitances as a function of the distance h' of the tuning portion 54 and the center conductor 18 with respect to the distance h between the housing 14 and the center conductor 18 as defined in FIG. 10. Hence, the capacitive coupled tuning arrangement of the invention, as shown in FIG. 10, is well suited for the application in metallized plastic housings.

EXPERIMENTAL RESULTS

Figure 13:
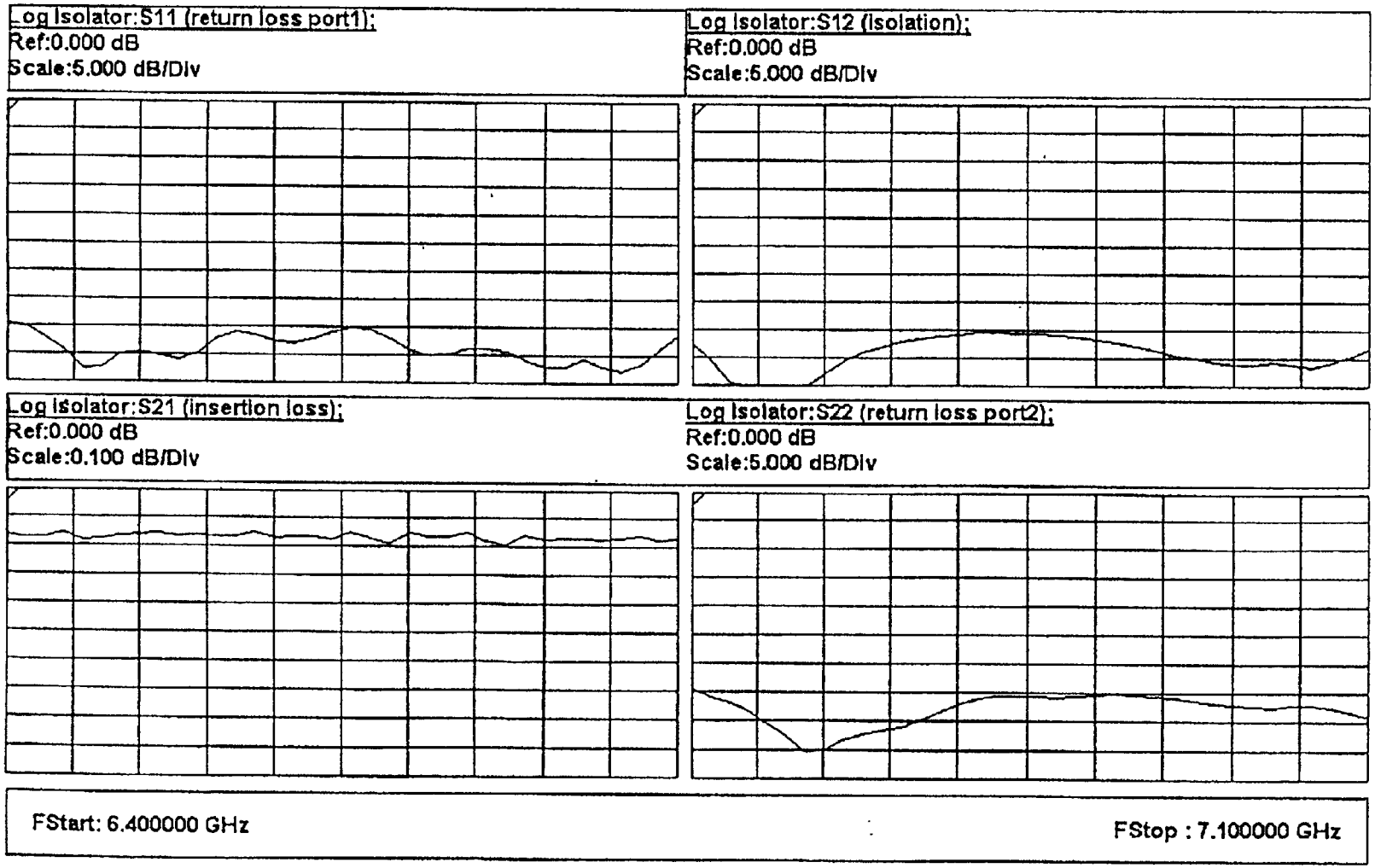
FIG. 13 represents various graphs showing measured s-parameters of a 6.8 GHz microwave isolator of the invention.

S-parameters of the microwave insulator 10 were measured and are shown in FIG. 13. The return loss across the whole temperature range (−30° C. . . . +70° C.) is greater than 26 dB. The insertion loss of max. 0.2 dB displays the high conductivity of the surface and demonstrates the perfect connection between connectors 40 and housing 12, 14. The high isolation of >26 dB indicates the temperature stable performance of the load 50.

Compliance to ETSI standard ETS300386 is an essential requirement for an application in microwave radio systems. The shielding against radiation was measured by using an EMC chamber at higher frequencies and by the "wire injection"-method at lower bands.

At higher frequency bands the penetration depth is 10 times lower than the metallization thickness. Therefore, from the point of view of metallization techniques, EMC problems are of minor concern. The molded plastic shows a smoother surface than milled aluminum, hence, the EMC behavior is comparable. Measurements show slightly better results. For lower frequencies the "wire-injection" method was used (cf. E. Habinger, A. Sidhu, G. Blasek, "Metallisieren von Kunststoffgehäusen unter EMV-, Umwelt-, and Recyclingaspekten", Eugen G. Leuze Verlag, Saulgau, 1998).

Figure 14:
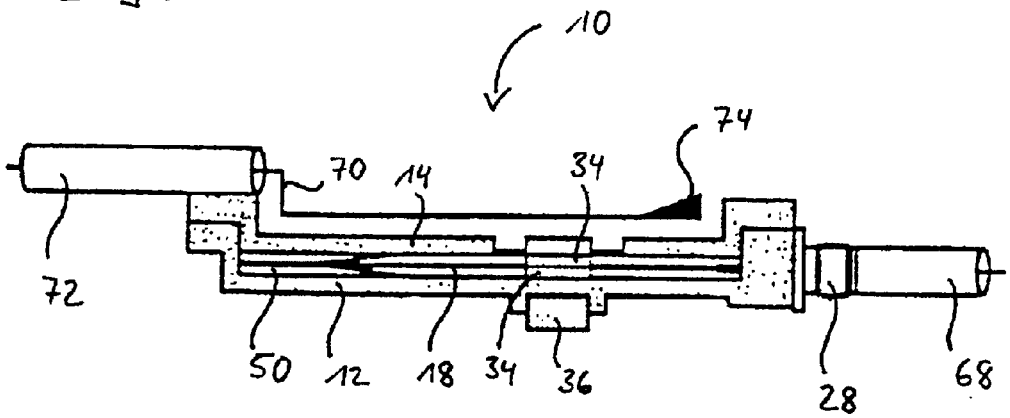
FIG. 14 shows a measurement set-up for the "wire-injection" method.
Figure 15:
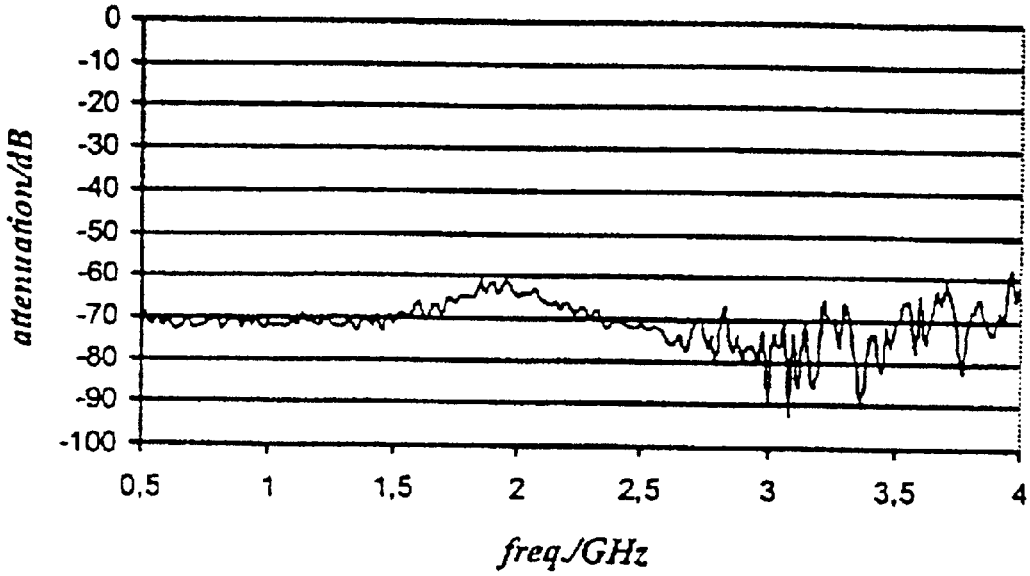
FIG. 15 is a graph showing the EMC shielding of the set-up of FIG. 14.

FIG. 14 shows the measurement set-up used for the "wire-injection" method. One port 28 of a microwave isolator 10 is fed with a signal source 68, while the remaining port 30 is terminated. The extended inner conductor 70 of a coaxial cable 72 is positioned parallel to the housing 12, 14 and couples to electromagnetic fields on the outer surface of the housing 12, 14. The line 70 has a 50Ω impedance and is terminated at an end 74. The frequency characteristic of the coupling is plotted in FIG. 15. The high shielding attenuation satisfies the requested EMC demands.

For verification purposes of ETSI requirements the isolator 10 was also exposed to environmental tests defined below:

temperature changes: 50 K/min in a temperature range of −70 . . . +150° C., high temperature storage: 21 days at 100° C., humid storage: 21 days at 85° C. and 85 humidity.

No detachment of the metallic surface was detected by visual inspection.

The verification of the electrical performance has shown no degradation of microwave parameters. Moreover, no noticeable influence on the EMC-performance could be observed after these tests. Hence, the successful completion of all tests has proved the applicability of plastic technology for microwave component designs.

The present invention therefore combines the advantages of low cost plastic technology for microwave components with the requirements of high performance microwave radio systems. Based on metallized plastic housings the simple integration of push-in connectors is demonstrated. Special designed tuning elements provide cost effective automated tuning capability without loosing electrical performance.

This invention presents a low cost isolator approach for radio link systems for the 3.4–13.5 GHz bands. The realization is based on easy manufacturing and assembly techniques. The application of cast silicone loads and metallized plastics housings are important features. To avoid air gaps between ferrite disks and housing, the region of the housing adjacent the ferrite region is designed having elastic behavior.

The introduction of plastic technology needs careful consideration of EMC demands as well as suitable integration of connectors and tuning elements. A push-in connector solution provides the required electrical contact with the housing. Moreover, a non-galvanic contact capacitive coupling tuning-approach is described facilitating automatic tuning procedures. Extensive EMC and environmental tests including performance measurements prove the applicability of this technology for microwave components designs.

Although the invention has been described with reference to a microwave isolator it is not limited to this. The tuning element, tuning arrangement, and method for influencing an electrical field in a microwave device may equally be applied tQ all kinds of microwave devices requiring a tuning means, particularly to those devices not having any center conductors, e.g. waveguides or microwave resonators, as well as to devices having metal housings instead of metallized plastic housings.

LIST OF REFERENCE NUMERALS

| | |
|---|---|
| 1 | tuning element |
| 3 | center conductor |
| 5 | tuning portion |
| 7 | locking portion |
| 9 | housing |
| 10 | isolator |
| 12 | housing part |
| 14 | housing part |
| 14a | housing wall |
| 16 | screws |
| 18 | strip-line center conductor |
| 20 | central/ferrite region |
| 22 | leg |
| 24 | leg |
| 26 | leg |
| 28 | input port |
| 30 | output port |
| 32 | isolated port |
| 34 | ferrite disk |
| 36 | magnet |
| 38 | membrane region |
| 40 | connector |
| 42 | rear end |
| 44 | lip |
| 46 | knurl |
| 48 | contact region |
| 50 | load |
| 52 | tuning element |
| 54 | tuning portion |
| 54a | capacitive coupling portion |
| 56 | air gap |
| 58 | insulating portion |
| 60 | conductive portion |
| 62 | thread |
| 64 | thread |
| 66 | socket |
| 68 | signal source |
| 70 | inner conductor |
| 72 | coax-cable |
| 74 | end |

What is claimed is:

1. A tuning arrangement for influencing an electric field within a microwave device having electrically conductive walls for guiding microwaves, the arrangement comprising: at least one tuning element capacitively coupled to a portion of said electrically conductive walls through a physical connection therewith, the physical connection being an electrically insulating connection, and the at least one tuning element also being capacitively coupled to a stripline conductor disposed in a space defined by said walls.

2. The tuning arrangement as claimed in claim 1, wherein the at least one tuning element comprises, in sequence, a tuning portion for influencing the electric field, a capacitive coupling portion which couples capacitively with said portion of said electrically conductive walls, an insulating portion, and a conductive or insulating locking portion.

3. The tuning arrangement as claimed in claim 2, wherein the locking portion comprises a screw thread provided either directly in at least one of said conductive walls or in an element inserted therein.

4. The tuning arrangement as claimed in claim 3, wherein the screw thread is a metal screw thread.

5. The tuning arrangement as claimed in claim 3, wherein the screw thread engages with a metal socket or an insulating socket secured to a housing of the microwave device.

6. The tuning arrangement as claimed in claim 5, wherein the housing of the microwave device is composed of a metallized plastic.

7. The tuning arrangement as claimed in claim 2, wherein the locking portion is a plug element received in a frictionally retained manner within a socket.

8. The tuning arrangement as claimed in claim 2, wherein the tuning portion is composed of any one of a group selected from a ferrite, a dielectric, a microwave absorbing material, and a metal.

9. A microwave device comprising:

a) an input port for injecting microwaves into said device;

b) electrically conductive walls for guiding the microwaves;

c) an output port for extracting the microwaves from said device; and d) at least one tuning element protruding into a space defined by said electrically conductive walls for influencing said microwaves, said at least one tuning element being capacitively coupled to a portion of said electrically conductive walls through a physical connection therewith, the physical connection being an electrically insulating connection.

10. The microwave device as claimed in claim 9, the device being a circulator.

11. The microwave device as claimed in claim 9, the device being a circulator configured as an isolator.

12. The microwave device as claimed in claim 9, wherein the at least one tuning element is also capacitively coupled to a stripline conductor disposed within said space defined by said electrically conductive walls.

13. The microwave device as claimed in claim 9, wherein the at least one tuning element comprises, in sequence, a tuning portion for influencing said microwaves, a capacitive coupling portion which couples capacitively with said portion of said electrically conductive walls, an insulating portion, and a locking portion.

14. The microwave device as claimed in claim 13, wherein the locking portion comprises a screw thread.

15. The microwave device as claimed in claim 14, wherein the screw thread is a metal screw thread.

16. The microwave device as claimed in claim 14, wherein the screw thread engages with a metal socket secured to said electrically conductive walls.

17. The microwave device as claimed in claim 9, wherein said electrically conductive walls are made from metallized plastic.

18. The microwave device as claimed in claim 17, wherein said electrically conductive walls comprise first and second molded plastic parts, said plastic parts comprising either an insulating plastic or a conductive plastic.

19. The microwave device as claimed in claim 18, wherein said plastic parts are plated with a metal layer.

20. The microwave device as claimed in claim 18, wherein said plastic parts are plated with a metal layer comprising silver.

21. The microwave device as claimed in claim 20, wherein said metal layer has a thickness between 0.1 $\mu$m and 20 $\mu$m and preferably a thickness of about 10 $\mu$m.

22. The microwave device as claimed in claim 9, including a strip-line center conductor arranged in said space defined by said electrically conductive walls.

23. The microwave device as claimed in claim 22, wherein said strip-line center conductor is arranged centrally between two metallized plastic parts forming said electrically conductive walls.

24. The microwave device as claimed in claim 22, including a pair of ferrite disks arranged on opposite sides of the center conductor and in contact with said electrically conductive walls.

25. The microwave device as claimed in claim 24, wherein a portion of said electrically conductive walls adjacent to said ferrite is elastic.

26. The microwave device as claimed in claim 24, wherein a portion of at least one of two metallized plastic parts forming said electrically conductive walls adjacent to said ferrite disk is formed as a membrane.

27. The microwave device as claimed in claim 24, further comprising means for generating a magnetic field extending through said ferrite disks.

28. The microwave device as claimed in claim 27, wherein said means is a permanent magnet arranged on one side of said ferrite disks.

29. The microwave device as claimed in claim 9, further comprising at least one absorber element provided in said space defined by said electrically conductive walls.

30. The microwave device as claimed in claim 29, wherein said absorber element is formed from an elastic material.

31. The microwave device as claimed in claim 29, wherein said absorber element is formed from an attenuating silicone material.

32. The microwave device as claimed in claim 9, wherein at least one of said input port and said output port is formed from a press-in connector.

33. The microwave device as claimed in claim 32, wherein a portion of an outer surface of said press-in connector engages with said electrically conductive walls being formed as a knurl.

34. The microwave device as claimed in claim 32, wherein a portion of said electrically conductive walls engaging with said press-in connector has a spring characteristic.

35. A tuning component, comprising: a metal socket or an insulating socket for insertion into a space defined by electrically conductive walls; and a tuning element comprising a conductive or insulating locking portion having a screw thread engagable with said socket, an insulating portion connected to said locking portion, and a tuning portion connected to said insulating portion and remote from said locking portion.

* * * * *